US005708231A

United States Patent [19]

Koon

[11] Patent Number: 5,708,231

[45] Date of Patent: Jan. 13, 1998

[54] DELAYED RELEASE CARTRIDGE FOR A FIREARM

[75] Inventor: Homer Koon, Denton, Tex.

[73] Assignee: Sigma Research, Inc., Carrollton, Tex.

[21] Appl. No.: 734,461

[22] Filed: Oct. 17, 1996

[51] Int. Cl.[6] ..... F42B 5/67; F42B 5/30

[52] U.S. Cl. ..... 102/439; 102/430; 102/466

[58] Field of Search ..... 102/430–434, 102/436–444, 446, 447, 464–468

[56] References Cited

U.S. PATENT DOCUMENTS

| | | | |
|---|---|---|---|
| 1,470,591 | 10/1923 | Behar | 102/430 |
| 2,358,951 | 9/1944 | Turechek | 102/430 |
| 2,862,446 | 12/1958 | Ringdal | 102/430 |
| 3,342,134 | 9/1967 | Stadler et al. | 102/444 |
| 4,024,819 | 5/1977 | Schirneker . | |
| 4,173,186 | 11/1979 | Dunham | 102/430 |
| 4,359,925 | 11/1982 | Abet et al. . | |
| 4,365,559 | 12/1982 | Gruaz . | |
| 4,802,415 | 2/1989 | Clarke et al. | 102/434 |
| 4,809,612 | 3/1989 | Ballruch et al. | 102/444 |
| 4,972,777 | 11/1990 | Algera . | |
| 5,259,288 | 11/1993 | Vatsvog . | |
| 5,557,059 | 9/1996 | Warren et al. | 102/434 |

FOREIGN PATENT DOCUMENTS

| | | | |
|---|---|---|---|
| 2 633 712 | 1/1990 | France . | |
| 705346 | 1/1941 | Germany | 102/430 |
| 24289 | 1/1985 | United Kingdom | 102/430 |
| WO 83/00213 | 1/1983 | WIPO . | |
| WO83/00213 | 1/1983 | WIPO | 102/430 |

*Primary Examiner*—Harold J. Tudor

*Attorney, Agent, or Firm*—Gregory M. Howison; Mark W. Handley

[57] ABSTRACT

A cartridge is disclosed for use in a ballistic weapon system. The cartridge includes a tubular case and a ballistic projectile. The projectile has an annular groove which extends into an exterior periphery of the projectile. The tubular case has a cylindrical sidewall and a substantially closed rearward end. The cylindrical sidewall defines an interior cavity for receiving at least a rearward portion of the projectile. An annular lug is integrally formed with the cylindrical sidewall and inwardly extends from the sidewall into the annular groove of the projectile, interlocking the projectile and the tubular case. Longitudinal slits are formed in the forward end of the tubular case to allow the case to expand for receipt of the projectile until the annular lug is aligned with and then inserted into the annular groove of the projectile. After the cartridge is fired, the annular lug restrains the projectile within the tubular cartridge case until combustion of the charge causes a rapid pressure buildup to exceed a predetermined pressure, which causes the predetermined shear strength of the annular lug to be exceeded. The annular lug then shears and the projectile moves forward from within the tubular case.

14 Claims, 1 Drawing Sheet

DELAYED RELEASE CARTRIDGE FOR A FIREARM

TECHNICAL FIELD OF THE INVENTION

The present invention relates in general to ballistic weapons systems and in particular to a cartridge for use in a firearm.

BACKGROUND OF THE INVENTION

Prior art cartridges have been used in ballistic weapon systems, such as firearms. Cartridges have included a tubular cartridge case within which is disposed a ballistic projectile, such as a bullet. The ballistic projectile typically protrudes from the forward end of the cartridge case. The forward end of the cartridge case is crimped around the projectile to retain the projectile within the cartridge case until the cartridge is fired. An explosive or propellant charge is disposed within the cartridge case, rearward of the projectile. An initiator device, such as an explosive cap, is disposed in the rearward end of the cartridge for igniting the charge to propel the projectile from within the cartridge case.

Once a prior art cartridge is fired, combustion of the charge causes the projectile to move forward from within the cartridge case. The crimping of the forward end of the cartridge case around the projectile only holds the projectile in position within the cartridge case until the cartridge is fired. Combustion of the charge causes high pressures to occur rearward of the moving projectile. The projectile is not restrained once combustion of the charge begins in order to avoid catastrophic damage to the weapon within which the cartridge is being fired.

SUMMARY OF THE INVENTION

The present invention disclosed and claimed herein comprises a cartridge for use in a ballistic weapon system. The cartridge has a tubular case and a projectile which is at least partially disposed within the tubular case. The tubular case has a cylindrical sidewall and a substantially closed rearward end. The cylindrical sidewall defines an interior cavity for receiving at least a rearward portion of the projectile. A propellant or explosive power charge is disposed within the interior cavity, rearward of the projectile. An annular lug extends between the tubular case and the projectile, interlocking the projectile and the tubular case. The annular lug has a predetermined shear strength in a direction of right of the projectile. After the cartridge is fired, the annular lug restrains the projectile from moving from within the tubular cartridge case until combustion of the charge causes a rapid pressure buildup which exceeds the predetermined shear strength of the lug. The annular lug then shears and the projectile moves forward and from within the tubular case.

In another aspect of the present invention, an annular groove for receiving the annular lug is formed into a circumferentially extending periphery of the projectile. The annular lug is integrally formed with the sidewall of the tubular case, and inwardly extends from said sidewall to engage within the annular groove of the projectile. The annular lug has a thickness which extends substantially perpendicular to a circumference of the projectile to define the shear strength of the annular lug.

In yet another aspect of the present invention, longitudinally extending slots are formed in the sidewall of the tubular case and extend rearward from the forward end of the tubular case to adapt the tubular case to expand for receiving the projectile during loading of the cartridge. The forward end of the tubular case expands to allow the projectile to be pushed inward past the annular lug until the annular groove is aligned to receive the annular lug such that the annular lug interlocks between the projectile and the tubular case.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
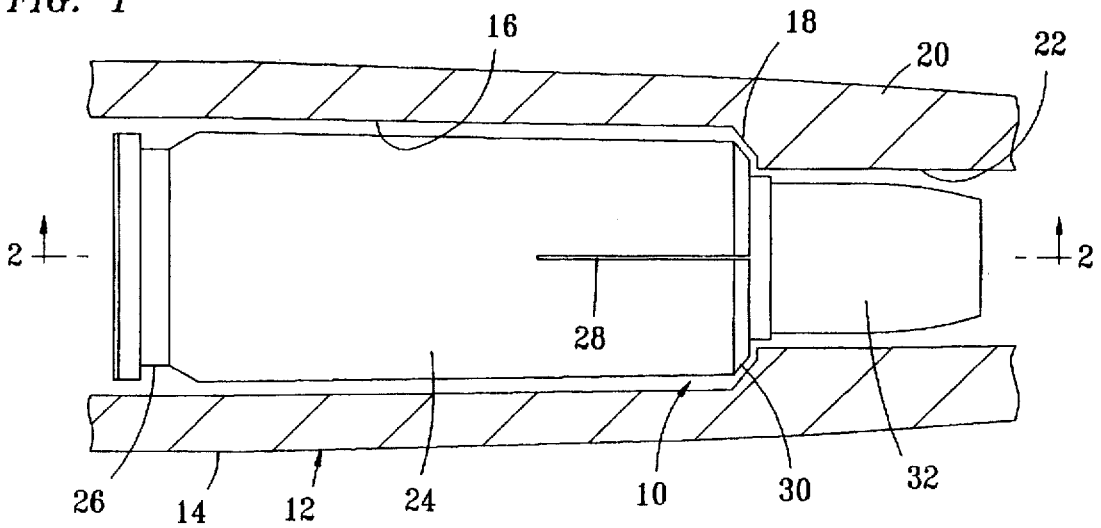
FIG. 1 is a partial section view illustrating a ballistic weapon system which includes a cartridge made according to the present invention.

Referring now to FIG. 1, there is illustrated a partial section view of a ballistic weapon system 12 and a side view of a cartridge 10 which is disposed within the ballistic weapon 12. The caliber of cartridge 10 and weapon 12 is preferably 7.62 mm. The weapon 12 includes a chamber 14 having a tapered bore 16 which tapers inward to a reduced diameter in a forward direction. Preferably, a 0.002 inch diametrical clearance is provided between an exterior periphery of the cartridge 10 and an interior surface of the chamber 14 of the Weapon 12. A stop 18 is disposed in the forward end of the chamber 14 for preventing the cartridge 10 from moving forward from within the chamber 14. A barrel 20 extends forward of chamber 15. The barrel 20 has a straight bore 22 which has spiraled grooves formed therein to provide rifling.

The cartridge 10 has a tubular case 24. A rearwardly disposed groove 26 is formed into the exterior periphery of the tubular case 24 for gripping the tubular case 24 for removal from within the chamber 14. Four slots 28 (one shown in FIG. 1) are provided by four straight slits. The slots 28 provide longitudinally extending, separations in the forward end 30 of the tubular case 24 so that the forward end 30 can expand for receiving a projectile 32 into the tubular case 24. The terminal portion of the forward end 30 of the tubular case 24 id beveled. The tubular cartridge case 24 and the chamber 14 are preferably tapered, with a 0.418 inch diametrical taper per inch.

The tubular cartridge case 24 is formed if a high strength polymer, which is preferably a thermosetting plastic. The cartridge case 10 is formed so that it has a strong enough flexural strength to retain the projectile 32 in position within the tubular cartridge case 24 as the cartridge is handle, loaded into a magazine clip, loaded into a chamber of an automatic weapon and then fired. The 0.002 inch diametrical clearance between the chamber 14 and the periphery of the tubular cartridge case 24 will prevent the slots 28 from opening when the cartridge 10 is fired. Additionally, the cartridge case 10 is formed so that is has maximum memory such that it will return to its initial shape almost immediately after firing so that it may be quickly ejected from the chamber 14 to allow weapon 12 to operate in a rapid fire mode.

The projectile 32 protrudes from the forward end of tubular case 24 in the embodiment shown in FIG. 1. The projectile 32 is preferably formed of a composite of materials, which includes a mixture of lead and nylon.

Figure 2:
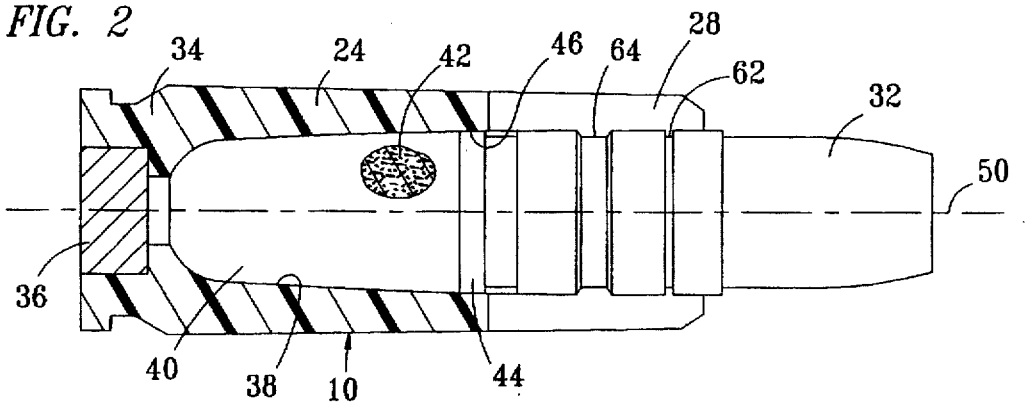
FIG. 2 is a sectional view of the cartridge, taken along section line 2—2 of FIG. 1.

Referring now to FIG. 2, there is illustrated a longitudinal section view of the cartridge 10, taken along section line 2—2 of FIG. 1. Cartridge 10 has a rearward end 34. An initiator device 36 is disposed in the reward end of the tubular case 24 to provide tubular case 24 with a substantially closed rearward end. An interior cavity 38 extends within the tubular case 24. A rearward section 40 of the interior cavity 38 contains an explosive or propellant charge 42, which is preferably gun powder. A forward section 44 of the interior cavity 38 defines an interior profile 46, which preferably extends forward of the rearward section 40 with a straight bore having two upsets or protuberances, which are discussed below in more detail. A cylindrical sidewall 48 of the tubular case 24 extends concentrically around a central axis 50 of the cartridge 10 and defines the interior cavity 38. The forward slots 28 are formed into the sidewall 48 by cutting straight slits therein.

Figure 3:
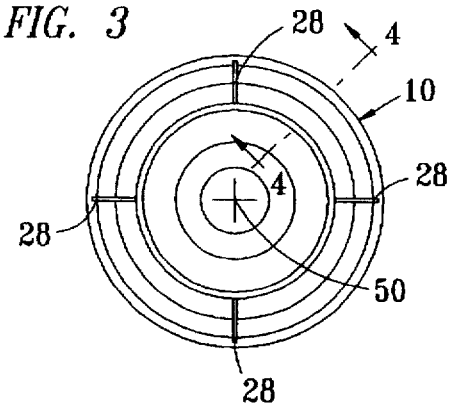
FIG. 3 is a front view illustrating the cartridge.

Referring now to FIG. 3, there is illustrated a front view of the cartridge 10. The four slots 28 are depicted as being equally spaced around the central longitudinal axis 50 of the cartridge 10. The slots 28 are equally spaced around central axis 50 at right angles to one another. The slots 28 preferably extend parallel to longitudinal axis 50. As illustrated in FIG. 2, the slots 28 preferably extend from the terminal portion of the forward end 30 of the tubular case 24, rearward to points in the sidewall 48 which are proximate to the rearward end of the projectile 32.

Figure 4:
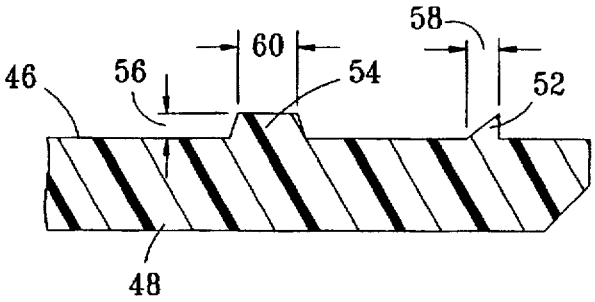
FIG. 4 is a partial section view illustrating the sidewall of a cartridge case of the cartridge, taken section line 4—4 of FIG. 3.

Referring now to FIG. 4, them is illustrated a partial longitudinal section view of sidewall 48 of the tubular cartridge case 24, taken along section line 4—4 of FIG. 3. The interior profile 46 of the sidewall 48 has two protuberances which define a forward annular lug 52 and a rearward annular lug 54. The annular lugs 52 and 54 preferably extend as annular tings or bands which continuously extend around the interior of the tubular case 24 to define two interiorly extending ribs, and which provide retainer members for retaining the projectile 32 within the tubular case 24. The lugs 52 and 54 preferably have a height 56 which preferably measures 0.015 inches. The forward annular lug 52 has a thickness 58 and the rearward annular lug 54 has a thickness 60. The base of the forward annul fir lug 52 has a thickness 58 which measures approximately 0.020 inches. The rearward annular lug 54 tapers from a outwardly disposed base having a thickness 60 of 0.060 inches to an interiorly disposed inward end having a thickness which measures approximately 0.050 inches. The combined thicknesses 58 and 60 of the forward annular lug 52 and the rearward annular lug 54, respectively, provide a combined overall shear strength for the profile 46 of the sidewall 48 of the tubular case 24.

Referring again to FIG. 2, the projectile 32 has two recesses formed in an exterior periphery thereof to define an annular groove 62 and an annular groove 64. The forward and rearward annular lugs 52 and 54 extend interiorly into the grooves 62 and 64; respectively, of the projectile 32. Each of the grooves 62 and 64 are at least 0.015 inches deep so that the annular lugs 52 and 54 will fully extend into the grooves 62 and 64, respectively. The diametrical clearance between the interior surface of chamber 14 and the exterior periphery of the tubular case 24 is approximately 0.002 inches, significantly smaller than the height 56 of the annular lugs 52 and 54 such that the annular lugs 52 and 54 will remain engaged within the grooves 62 and 64, respectively.

Referring now to FIGS. 3 and 4, it should be noted that the annular lugs 52 and 54 are segmented, each being cut into four segments by the four slots 28. In other embodiments of the present invention, lugs may be utilized which have only a portion of such segments which do not combine to extend substantially fully around the annular space between the cartridge case and projectile as shown for cartridge 10. Substantially discontinuous protuberances may be provided for extending into non-continuous recesses, rather than having the substantially continuous segmented annular lugs 52 and 54 which fully extend around and into the continuous annular grooves 62 and 64.

Operation to load the projectile 32 into the forward end of the tubular case 24 are now described. First, the initiator device 36 is mounted into the rearward end 34 of the tubular case 24. The rearward section 40 of the interior cavity 38 is filled with the charge 42. It should be noted that the rearward section 40 of the interior cavity 38 is preferably sized to hold a predetermined volume of the charge 42 so that the load for the cartridge 10 will be appropriate. Then, the projectile 32 is pushed rearwardly and into the forward section 44 of the interior cavity 38. The four longitudinally extending slots 28 allow the forward section of the sidewall 48, which defines the forward section 44 of the interior cavity 38, to expand outward until the grooves 62 and 64 are aligned interiorly aside of the lugs 52 and 54, respectively. Then, the lugs 52 and 54 extend into the grooves 62 and 64, respectively, and the forward section of the sidewall 48 which defines the forward section 44 of the interior cavity 38 returns to its initial, relaxed position, which is shown in FIGS. 1 and 2.

The cartridge 10 may then be chambered within the chamber 14 of the weapon 12. The tapered bore 16 preferably provides an annular gap between the bore 16 and the exterior periphery of the cartridge 10 which measures approximately a combined 0.002 inches in a diametrical direction across the chamber 14. When the cartridge 10 is fired, the small diametrical clearance between the tapered bore 16 of the chamber 14 and the exterior surface of the sidewall 48 of the tubular case 24 prevents the lugs 52 and 54 from being withdrawn from extending within the grooves 62 and 64 of the projectile 32. As combustion of the charge 42 continues, the pressure builds up within the interior cavity 38, rearward of the projectile 32. Then, when the pressure builds to a sufficient pressure, the shear strength of the combined thicknesses 58 and 60 of the annular lugs 52 and 54 is exceeded. Annular lugs 52 and 54 then shear and the projectile 32 is released from the cartridge case 24.

The predetermined thicknesses 58 and 60 of the annular lugs 52 and 54 provide a predetermined shear strength. Knowing the predetermined shear strength of the annular lugs 52 and 54 allows the pressure within the interior cavity 38 at which the annular lugs 52 and 54 shear to be determined and substantially repeatable. Thus, the projectile 32 is retained or held within the forward end of the interior cavity 38 of the tubular case 24 as the pressure builds within the interior cavity 38 during combustion of the charge 42 to a predetermined pressure.

Restraining the projectile 32 within the interior cavity 38 of the tubular case 24 with a lug of a predetermined shear strength results in transferring a larger impulse to the projectile 32 during combustion of the charge 42 within the interior cavity 38. With the build up of pressure within the interior cavity 38, the force which is applied against the rearward end of the projectile 32 increased. After the annular lugs 52 and 54 are sheared, larger forces are also applied to the rearward end of the projectile as it travels through a barrel of the weapon 12. Thus the integral of the product of the force applied to the projectile 32 times the time over which the force is applied, summed over the time over which the force is applied to the projectile 32, results in a larger impulse being applied to the projectile 32. As has been empirically determined in testing a prototype model of the present invention, restraining the projectile until a predetermined shear strength is exceeded provides the projectile 32 with a much larger momentum than that of prior art cartridges of similar sizes and loads. The larger momentum translates into higher muzzle velocities, and consequently a much larger kinetic energy for the projectile 32 than that which would have occurred had the projectile 32 not been restrained within the interior cavity 38 until the combined shear strengths of the forward and rearward annular lugs 52 and 54 were exceeded.

A cartridge made according to the present invention has resulted in a powder charge of one-third the size of previous powder charges for cartridges of a similar caliber resulting in the same muzzle exit velocities than that encountered with a full powder charge. Additionally, with higher muzzle exit velocities, the distance range over which the weapon is of acceptable accuracy may be increased over that of previous weapon systems. Initial tests of a 30-caliber prototype weapon indicate that the range was increased from 100-yards for conventional weapons to an improved range of 150-yards.

Additionally, barrels of approximately one third the length of previous, prior art systems utilizing prior art cartridges can be utilized. In the prior art, to exceed high ballistic velocities, longer barrels were utilized so that the charge could fully burn prior to exiting the muzzle of a barrel. However, with more combustion of the charge occurring prior to release of the projectile from within the cartridge case of a cartridge made according to the present invention, shorter barrels may be utilized. Tests have indicated that similar muzzle velocities may be attained with cartridges which restrain the projectiles within weapons that have barrels of lengths that measure approximately one to two thirds of the size of the barrels of weapons in which the projectiles are not restrained within the cartridges.

The present invention provides several advantages over prior art cartridges. A cartridge made according to the present invention will retain the projectile within the cartridge until a shear strength of a retainer member is exceeded. This provides for a predetermined shear strength, which results in a greater impulse acting against the projectile to transfer more of the power of the combustion of the explosive or propellant charge into the kinetic energy of the projectile. By restraining the projectile within the tubular cartridge case until a predetermined shear strength is exceeded in response to a pressure buildup within the cartridge case, a larger force is applied to the projectile as compared to cartridges in which the projectile is merely held in place until ignition of the charge. A cartridge case made according to the present invention can greatly reduce the amount of charge required for obtaining a selected projectile velocity, and it can extend the effective range of the weapon system within which the cartridge is used.

Although the preferred embodiment has been described in detail, it should be understood that various changes, substitutions and alterations can be made therein without departing from the spirit and scope of the invention as defined by the appended claims.

What is claimed is:

1. A cartridge for use in a ballistic weapon system, comprising:

a projectile having an exterior periphery and two annular recesses which are spaced apart and formed into said exterior periphery;

a tubular case having a one-piece plastic body which includes an interior cavity defined by at least one sidewall and a substantially enclosed rearward end;

said one piece plastic body including two annular retaining members which inwardly extend from said sidewall of said tubular case into said recesses of said projectile, interlocking said projectile and said tubular case;

wherein said projectile extends into said interior cavity of said tubular case, such that said recesses formed into said exterior periphery of said projectile are aligned with corresponding ones of said retaining members and said retaining members extend into respective ones of said recesses to interlock said projectile to said tubular case;

said sidewall of said tubular case including at least one slot which extends rearward from a forward end of said tubular case and rearward of said two retaining members for allowing said forward end of said tubular case to expand and receive said projectile, and then to return to a closed position such that said retaining members extend into said recesses to interlock said projectile to said tubular case; and said retaining members together having a predetermined shear strength for interlocking said projectile within said tubular case until said shear strength is exceeded and said retaining member is sheared in response to a predetermined pressure buildup within said tubular case when said cartridge is fired.

2. The cartridge according to claim 1, wherein said tubular case includes two slits which extend in parallel on opposite sides of said tubular case, one of which defines the aforementioned said at least one slot.

3. The cartridge according to claim 1, wherein said retaining members are defined by annular lugs which inwardly extend from said sidewall, one having a triangular shaped cross-section and the other having a generally rectangular shaped cross-section for engaging within respective ones of said recesses formed into an exterior surface of said projectile.

4. The cartridge according to claim 1, wherein said projectile includes a cylindrical body into which said recesses extend, each defining a groove which circumferentially extends transversely into a periphery of said cylindrical body with a width for receiving a corresponding one of said retaining members to interlock said projectile to said tubular case.

5. The cartridge according to claim 4, wherein said retaining members are annular lugs which inwardly extend from said sidewall for a distance of 0.015 inches into said grooves of said projectile to interlock said tubular case and said projectile.

6. A cartridge for use in a ballistic weapons system, comprising:

a projectile having a cylindrical body with two annular grooves formed transversely into an exterior periphery thereof, spaced apart in a longitudinal direction;

a tubular case having a one-piece plastic body, wherein said one-piece plastic body includes a cylindrical sidewall and a substantially enclosed rearward end which define an interior cavity for receiving at least a rearward portion of said projectile;

said rearward portion of said projectile being disposed within said interior cavity of said tubular case;

said one-piece plastic body of said tubular case further including two annular lugs which are spaced apart from one another and inwardly extend from said cylindrical sidewall for aligning with and fitting within respective ones of said grooves of said projectile, interlocking said projectile and said tubular case; and wherein a plurality of slots extend longitudinally into said cylindrical sidewall of said tubular case, each of said slots extending longitudinally forward of and rearward of said annular lugs, and each of said slots extending to a forward end of said tubular case; and said annular lugs together having a predetermined shear strength in a direction of right of said projectile for interlocking said projectile and said tubular case until said shear strength of said annular lugs is exceeded by buildup of a preselected pressure within said interior cavity of said tubular case and said annular lugs are sheared when said cartridge is fired.

7. The cartridge according to claim 6, wherein said annular lugs together have combined thicknesses which extend substantially parallel to a circumference of said exterior periphery of said projectile to define said shear strength.

8. The cartridge according to claim 6, wherein said grooves are continuous and circumferentially extend transversely into said periphery of said cylindrical body, spaced apart and with a width for receiving corresponding ones of said annular lugs to interlock said projectile to said tubular case; and wherein said annular lugs are received within respective ones of said grooves.

9. The cartridge according to claim 8, wherein said annular lugs are integrally formed with said tubular case and inwardly extends from said sidewall for a distance of 0.015 inches into said grooves of said projectile to interlock said tubular case and said projectile.

10. The cartridge according to claim 8, wherein said annular lugs are segmented such that a plurality of discontinuous segments of said annular lugs extend into said grooves.

11. The cartridge according to claim 10, wherein said annular lugs have thicknesses which extend substantially parallel to a circumference of said projectile along said groove and which define said shear strength; and one of said annular lugs having a triangular shaped cross-section and the other of said annular lugs having a generally rectangular shaped cross-section with tapered edges for engaging within respective ones of said grooves formed into said exterior periphery of said projectile.

12. The cartridge according to claim 11, wherein said annular lugs have a height which extends transversely from said sidewall into said groove, such that said height of said annular lugs extend into said groove a distance which is larger than a clearance defined between said projectile and an interior surface of a chamber of the ballistic weapon system to interlock said projectile and said lug until said shear strength is exceeded when said cartridge is fired.

13. A cartridge for use in a ballistic weapons system, comprising:

a projectile having a cylindrical body with two annular grooves formed transversely into an exterior periphery thereof, spaced apart in a longitudinal direction, said grooves being continuous and circumferentially extending transversely into said periphery of said cylindrical body;

a tubular case having a one-piece plastic body, wherein said one-piece plastic body includes a cylindrical sidewall and a substantially enclosed rearward end which define an interior cavity for receiving at least a rearward portion of said projectile;

said rearward portion of said projectile being disposed within said interior cavity of said tubular case;

said one-piece plastic body of said tubular case further including two annular lugs which are spaced apart from one another and inwardly extend from said cylindrical sidewall for aligning with and fitting within respective ones of said grooves of said projectile, interlocking said projectile and said tubular case;

one of said annular lugs having a triangular shaped cross-section and the other of said annular lugs having a generally rectangular shaped cross-section with tapered edges for engaging within respective ones of said grooves formed into said exterior periphery of said projectile;

wherein a plurality of slots extend longitudinally into said cylindrical sidewall of said tubular case, each of said slots extending longitudinally forward of and rearward of said annular lugs, segmenting each of said annular lugs, and each of said slots extending to a forward end of said casing;

said annular lugs together having a predetermined shear strength in a direction of flight of said projectile defined by respective thicknesses of said annular lugs in said direction of flight; and said annular lugs being received within respective ones of said grooves, interlocking said projectile and said tubular case until said shear strength of said annular lugs is exceeded by buildup of a preselected pressure within said interior cavity of said tubular case and said annular lugs are sheared when said cartridge is fired.

14. The cartridge according to claim 13, wherein said annular lugs inwardly extend from said sidewall for a distance of 0.015 inches into respective ones of said grooves into said projectile to interlock said tubular case and said projectile.

* * * * *